United States Patent [19]

Ohishi et al.

[11] Patent Number: 4,975,665

[45] Date of Patent: Dec. 4, 1990

[54] REMOTE-CONTROLLED CIRCUIT BREAKER

[75] Inventors: Hirotoshi Ohishi; Tatunori Ikeda; Manabu Sogabe, all of Fukuyama, Japan

[73] Assignee: Mitsubishi Denki Kabushiki Kaisha, Tokyo, Japan

[21] Appl. No.: 421,995

[22] Filed: Oct. 16, 1989

[30] Foreign Application Priority Data

Oct. 17, 1988 [JP] Japan ..... 63-261893
Oct. 17, 1988 [JP] Japan ..... 63-261894
Oct. 17, 1988 [JP] Japan ..... 63-261895

[51] Int. Cl.[5] ..... H01H 75/00
[52] U.S. Cl. ..... 335/14; 335/6
[58] Field of Search ..... 335/6, 14, 16, 20, 35, 335/172–174

[56] References Cited

U.S. PATENT DOCUMENTS 4,623,859 11/1986 Erickson et al. ..... 335/14
4,631,507 12/1986 Guery et al. ..... 335/27
4,636,760 1/1987 Lee ..... 335/14
4,855,698 8/1989 Cohen et al. ..... 335/14
4,897,625 1/1990 Yokoyama et al. ..... 335/14

FOREIGN PATENT DOCUMENTS 60-30029 2/1985 Japan .
62-15723 1/1987 Japan .

*Primary Examiner*—H. Broome
*Assistant Examiner*—Lincoln Donovan
*Attorney, Agent, or Firm*—Burns, Doane, Swecker & Mathis

[57] ABSTRACT

A remote-controlled circuit breaker has an operation mechanism unit (300), for selecting one of an off state and a remote-controllable state of the circuit breaker, and a compact electromagnetic unit (200) and a movable contact (11, 12) which makes/breaks contact with a fixed contact in connection with a motion of the electromagnetic unit only in the remote-controllable state; and the movable contact breaks contact with the fixed contact irrespective of the motion of the electromagnetic unit at the time when an overcurrent tripping unit (400) is operated by a fault.

4 Claims, 12 Drawing Sheets

REMOTE-CONTROLLED CIRCUIT BREAKER

FIELD OF THE INVENTION AND RELATED ART STATEMENT

1. Field of the Invention

The present invention relates to a remote-controlled circuit breaker and more particularly to a remote-controlled circuit breaker having an improved high-frequency making/breaking operation.

2. Description of the Related Art

FIG. 11 is a schematic diagram showing the conventional driving circuit for a three-phase induction motor M. An A.C. voltage is applied to the motor M through electric power line (not shown) via a conventional circuit breaker 1 and a magnetic contactor 2 connected in series with each other. The circuit breaker 1 is provided primarily to protect the motor M and connection wires 4 from heat-damage by a short-circuit or an overload. Since the rated lifetime of the contacts of the conventional circuit breaker 1 is generally under 10,000 switching cycles, the circuit breaker 1 is not suitable for making/breaking its contacts with high frequency. Further, it is difficult to effect remote-control operation of the circuit breaker 1.

On the other hand, the magnetic contactor 2 is suitable for making/breaking its contacts with fairly high frequency. If only the magnetic contactor 2 were used to drive the motor M, however, without the series-connected circuit breaker 1, welding of contacts in the magnetic contactor 2 could occur when a large current flows through the contacts as a result, for example, of a short-circuit, rendering the magnetic contactor useless. For the above-mentioned reasons, the circuit breaker 1 and the magnetic contactor 2 are connected in series with each other, thereby realizing both a breaking function in response to an excessive current and a high-frequency making/breaking function susceptible to remote control.

As shown in FIG. 12, both the circuit breaker 1 and the magnetic contactor 2 are conventionally fixed to a common casing 3 to constitute a protection and control unit.

However, since the circuit breaker 1 and the magnetic contactor 2 are separate devices, many interconnecting wires 4 are necessary in the casing 3. In order to provide sufficient space to accommodate both devices (the circuit breaker 1 and the magnetic contactor 2), the interconnecting wires 4, and various wire connecting devices, the casing 3 must unavoidably be large.

U.S. Pat. No. 4,631,507 discloses a switching device having contacts which are actuated either by an armature of a remote-controllable electromagnet or by a tripping device. However, the mechanism for transmitting motion of the armature is provided independently of that for transmitting motion of the tripping device to the contacts, and each mechanism is assembled into one unit casing. Therefore, construction of the switching device is complicated and the switching device is still not as compact as possible.

OBJECT AND SUMMARY OF THE INVENTION

An object of the present invention is to offer a remote-controlled circuit breaker having breaking ability for large current and an ability for making/breaking contact very frequently for the ordinary current within a small-sized single integrated casing therefor. In other words, the object of the present invention is to embody a function of a magnetic contactor in a compact unit which can be easily incorporated into the circuit breaker.

In order to achieve the above-mentioned object, the remote-controlled circuit breaker of the present invention comprises:

a casing;

a fixed contact fixedly mounted to the casing;

a movable contact movably mounted to the casing to move in and out of contact with the fixed contact;

an electromagnetic unit comprising a channel-shaped magnet frame which has a pair of opposing end-plane portions and is fixedly mounted to the casing, a cylindrical electromagnetic coil mounted in the magnet frame, an E-shaped fixed iron core, a central leg of which is inserted into the electromagnetic coil from one side of the electromagnetic coil and a pair of both sides legs are inserted into the magnet frame from the one side through a pair of openings of the end-plane portions, thereby to be fixed to the magnet frame, an E-shaped movable iron core, a central leg of which is inserted into the electromagnetic coil through an opening of the magnet frame from the other side of the electromagnetic coil and a pair of both sides legs are inserted into the magnet frame from the other side through the opening of the magnet frame, thereby to be movable to the magnet frame, a transmission lever which is pivottaly mounted to the magnet frame, a holder which is held by an end part of the transmission lever to hold the movable iron core into and out of contact with the fixed iron core, and a spring which urges the movable iron core away from the fixed iron core;

a control lever which is pivotally mounted to the casing to move the movable contact into and out of contact with the fixed contact;

operation means, including an operation handle, for releasably holding the control lever, the operation means forming a toggle and holding the control lever in a position for moving the movable contact out of contact with the fixed contact when the operation handle is in a first position and releasing the control lever to allow a predetermined rotation thereof when the operation handle is in a second position;

an overcurrent tripping unit for causing the operation means and the control lever to actuate to move the movable contact out of contact with the fixed contact when a current greater than a predetermined value flows through the circuit breaker; and a transmission lever which is pivotally mounted to the casing to transmit a motion of the movable iron core to the control lever.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENTS

Hereafter, preferred embodiments of the present invention are described with reference to the accompanying drawings.

Figure 1:
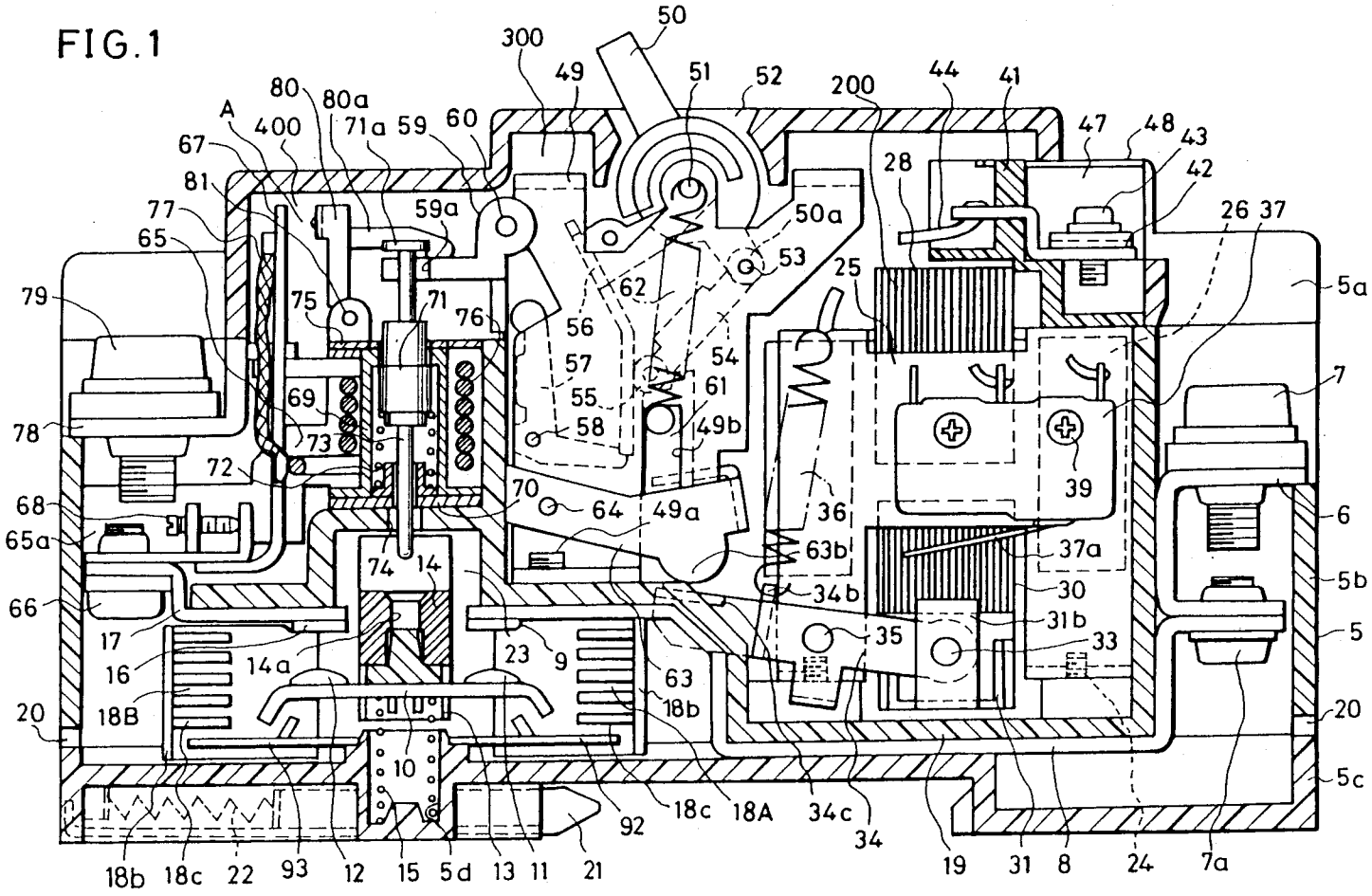
FIG. 1 is a cross-sectional side view showing a remote-controlled circuit breaker in a state such that an operation handle 50 is put in its OFF-position and a command of the remote control is of off state.
Figure 2:
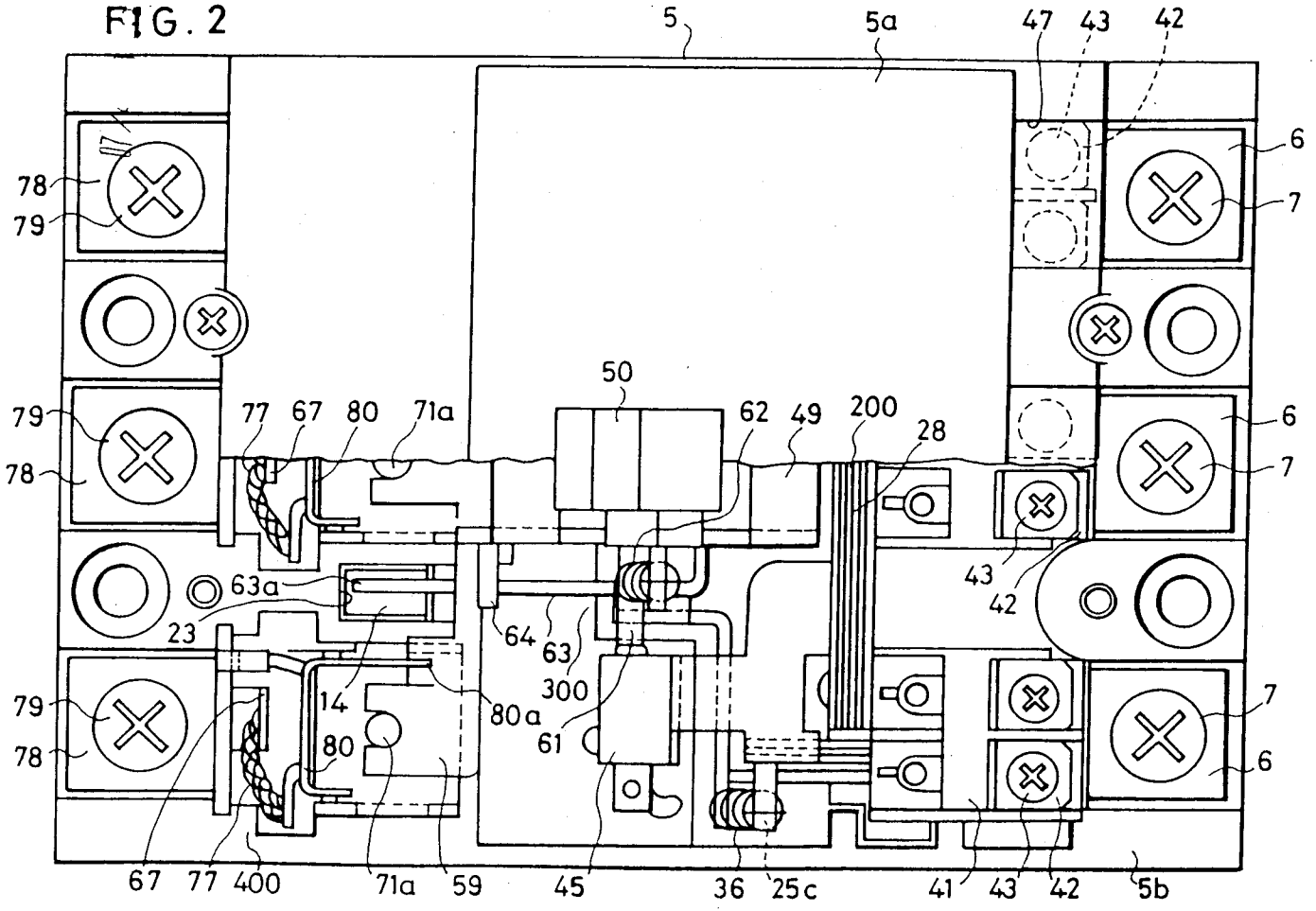
FIG. 2 is a plan view of the circuit breaker with its front cover 5*a* partially removed.
Figure 3:
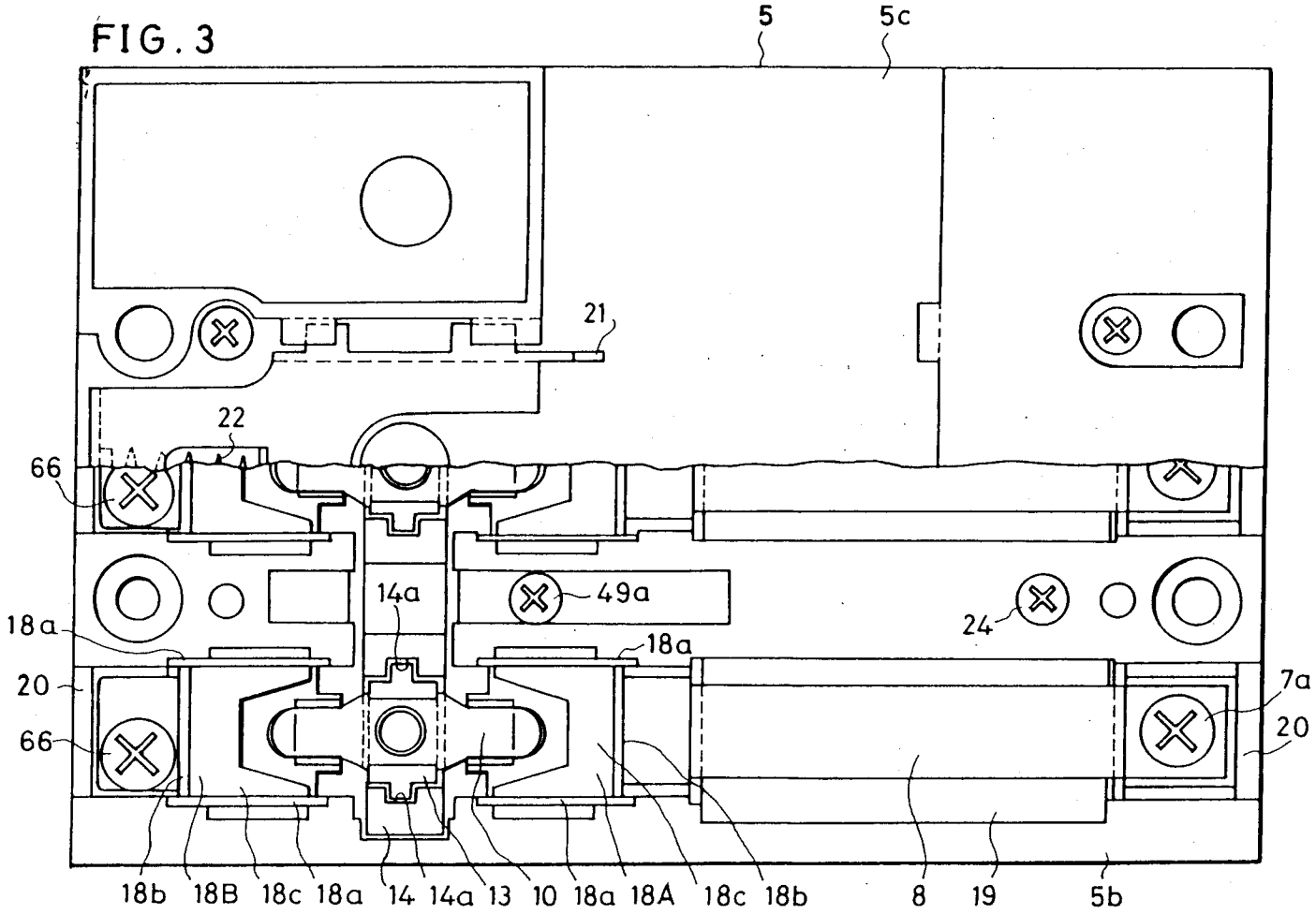
FIG. 3 is a bottom view of the circuit breaker with its rear cover 5*c* partially removed.
Figure 3A:
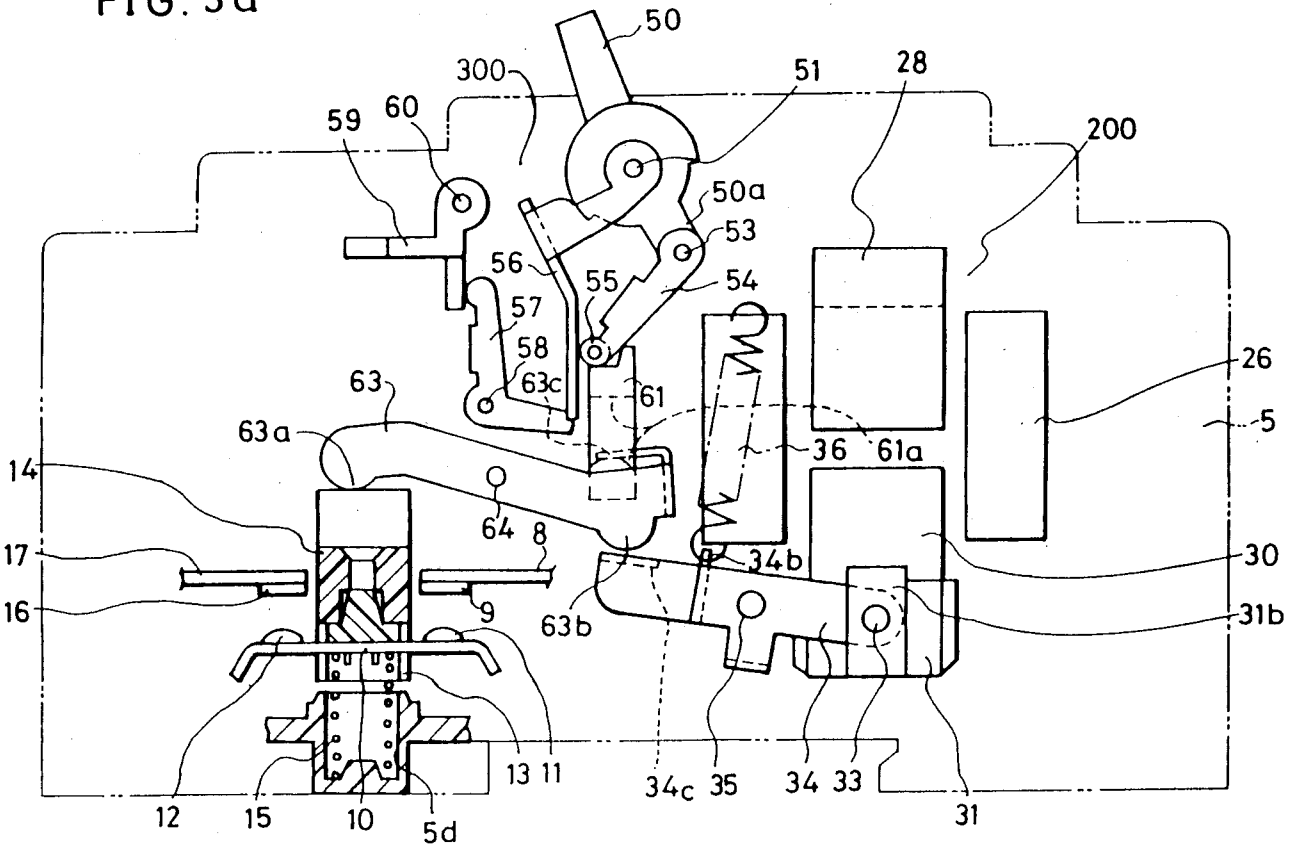
FIG. 3*a* is an internal side view showing main parts of the circuit breaker in an off state.
Figure 4:
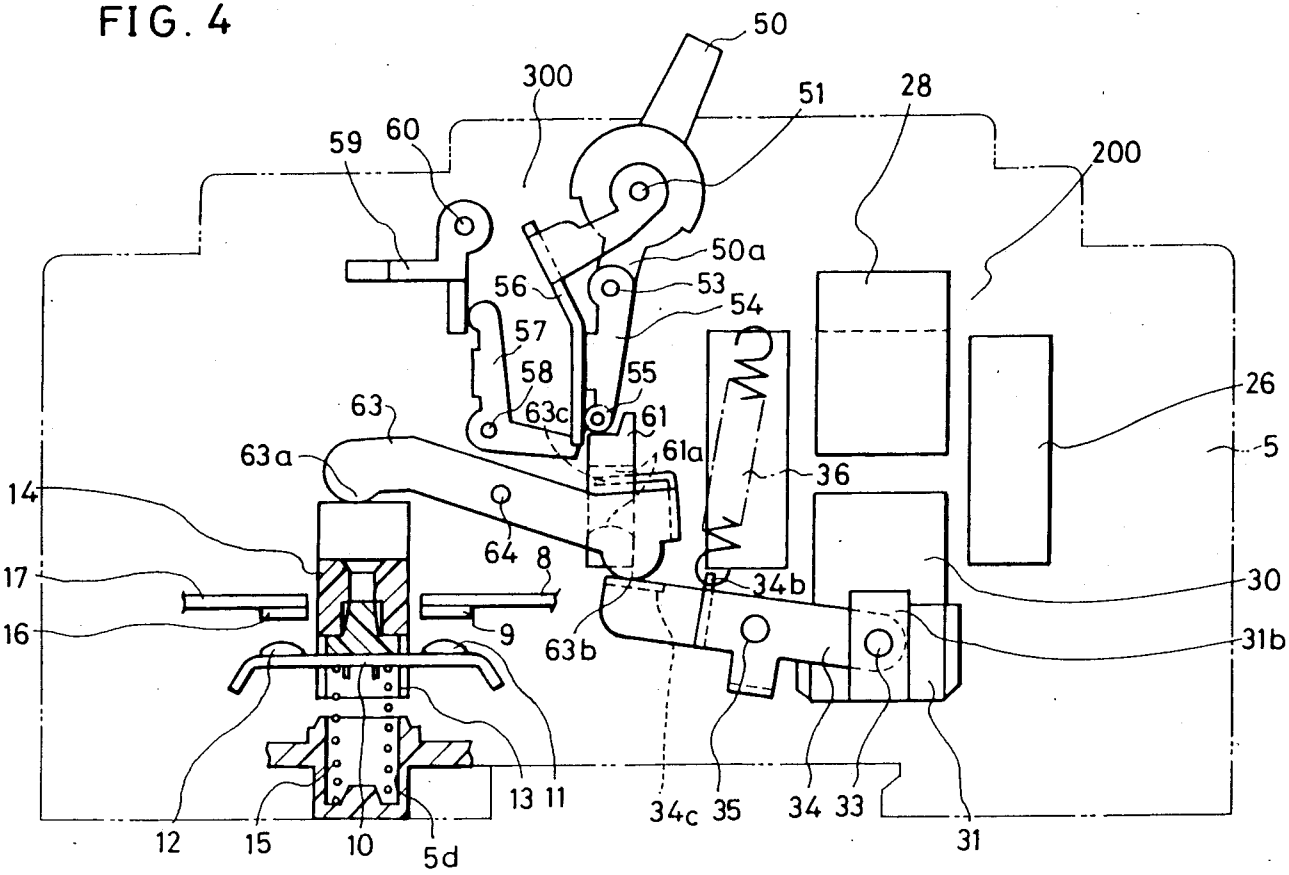
FIG. 4 is an internal side view showing main parts of the circuit breaker in a state that the operation handle 50 is put in its AUTO-position and a command of the remote control is of off state.
Figure 5:
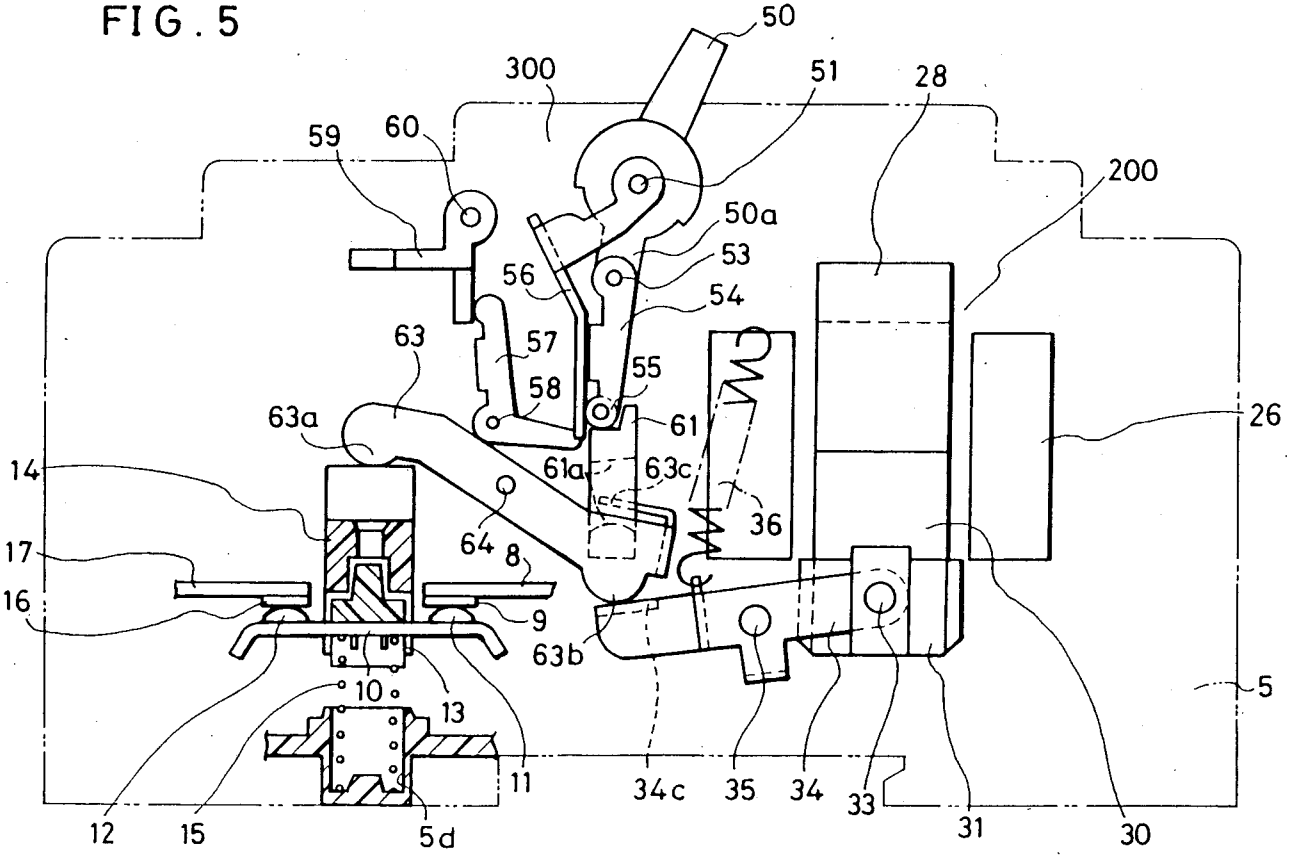
FIG. 5 is an internal side view showing main parts of the circuit breaker in a state that the operation handle 50 is put in the AUTO-position and a command of the remote control is of on state.
Figure 6:
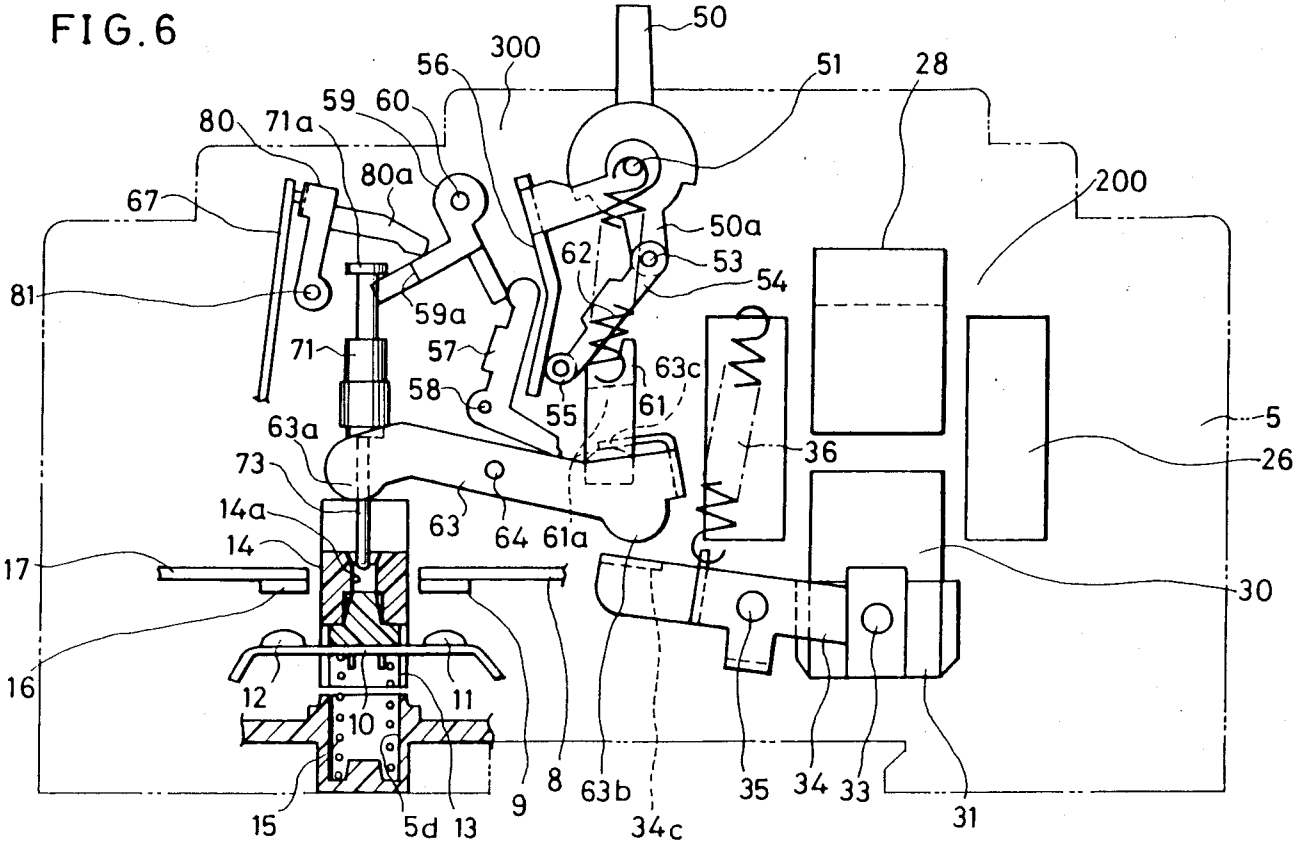
FIG. 6 is an internal side view showing main parts of the circuit breaker in a trip state.

FIG. 1 is a cross-sectional side view showing a remote-controlled circuit breaker in a state such that an operation handle 50 is put in its OFF-position and a command of the remote control is of off state. FIG. 2 is a plan view of the circuit breaker with its front cover 5*a* partially removed. FIG. 3 is a bottom view of the circuit breaker with its rear cover 5*c* partially removed. FIG. 3*a* is an internal side view showing main parts of the circuit breaker in an off state. FIG. 4 is an internal side view showing main parts of the circuit breaker in a state that the operation handle 50 is put in its AUTO(automatic)-position and a command of the remote control is of off state. FIG. 5 is an internal side view showing main parts of the circuit breaker in a state that the operation handle 50 is put in the AUTO-position and a command of the remote control is of on state. FIG. 6 is an internal side view showing main parts of the circuit breaker in a trip state.

Figure 10:
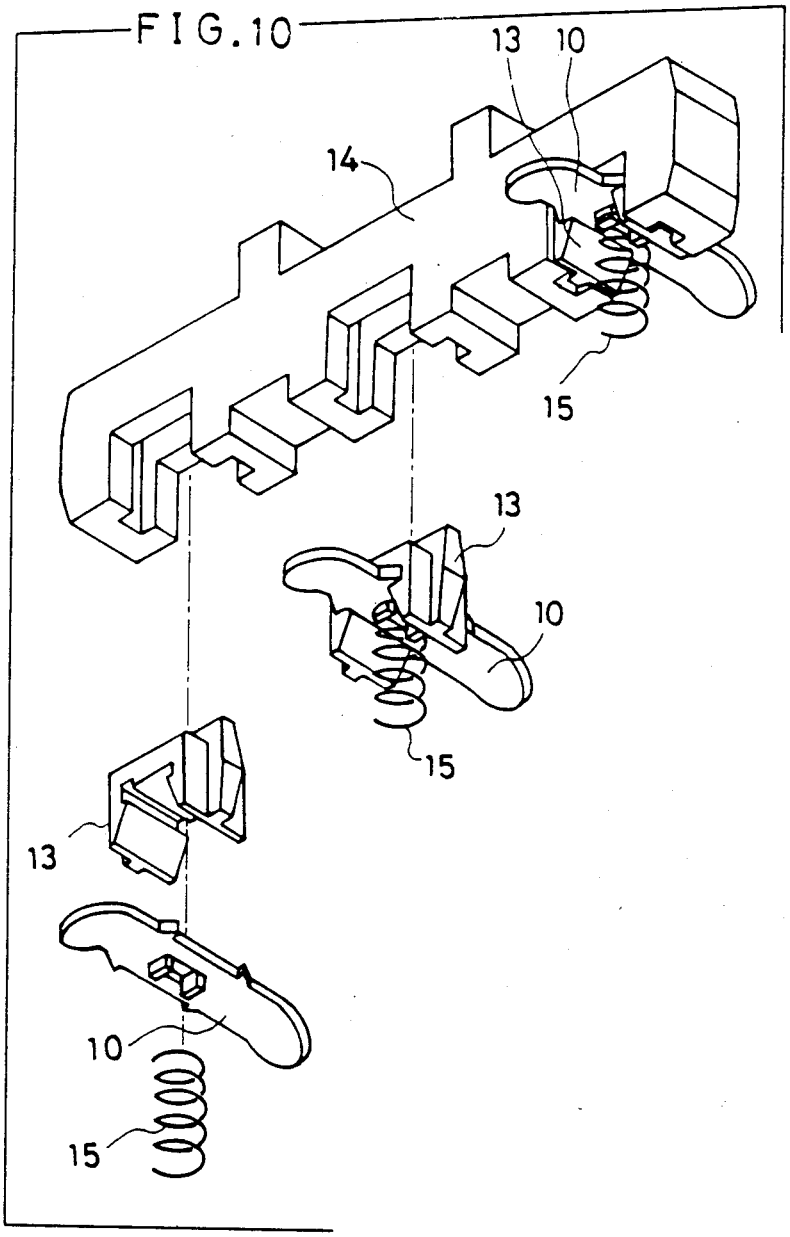
FIG. 10 is a perspective view showing a movable conductor 10, a tension spring 15, a holder 13 and a crossbar 14 of the present invention.
Figure 11:
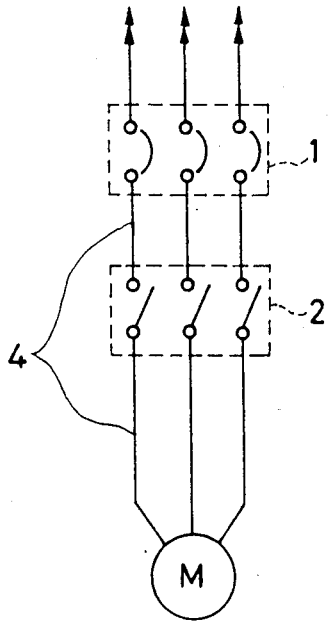
FIG. 11 (Prior Art)
FIG. 11 is the schematic diagram showing the conventional driving circuit for the three-phase induction motor.
Figure 12:
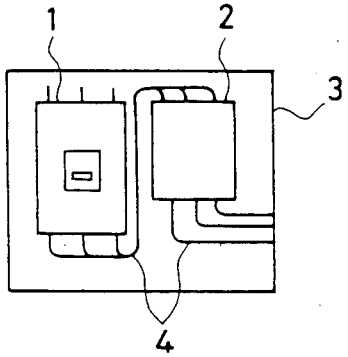
FIG. 12 (Prior Art)
FIG. 12 is the plan view showing the circuit breaker 1 and the magnetic contactor 2 which are mounted onto the casing 3.

In FIG. 1, a casing 5 comprises a front cover 5*a*, a base 5*b* and a rear cover 5*c*. A terminal 6 of power-source side is fixed in the base 5*b* and has a screw 7 thereon. A fixed conductor 8, one end of which is connected with the terminal 6 by a screw 7*a*, is held under the base 5*b* as a conductor of power-source side. A fixed contact 9 of power-source side is fixed on the other end of the fixed conductor 8. A movable conductor 10, which is movably held to the casing 5, has a pair of movable contacts 11 and 12. The movable contact 11 is disposed to make contact with the fixed contact 9, and the movable contact 12 is disposed to make contact with a fixed contact 16 which is fixed to a fixed conductor 17 of load-side. The movable conductor 10 is held by a holder 13 which is made of insulating material. A crossbar 14 is disposed to traverse the movable conductors 10 of all phases, thereby straddling over the movable conductors 10. The holder 13 is slidably fit in a groove 14*a* of the crossbar 14. A compression spring 15, which is mounted in a hole 5*d* formed in the rear cover 5*c*, urges the movable conductor 10 upward, thereby to make contact between the fixed contacts 9, 16 and the movable contacts 11, 12, respectively. FIG. 10 is a perspective view showing detailed construction of the movable conductor 10, the holder 13, the crossbar 14 and the compression spring 15. In FIG. 1, arc extinguishing chambers 18A and 18B are provided in a right-hand side and a left-hand side of the holder 13, respectively. Each of the arc extinguishing chambers 18A and 18B comprises a pair of insulating sheets 18*a* (FIG. 3), an exhaust sheet 18*b* (FIG. 3) and plural grids 18*c* encircled by the insulating sheets 18*a* and the exhaust sheet 18*b*. The grids 18*c* are made of magnetically soft substance such as iron sheet. An exhaust passage 19 (FIG. 1 or 3) formed by the base 5*b* and the rear cover 5*c* is communicated with a pair of vents 20 which are formed in right and left ends of the base 5*b* in FIG. 1. A metal finger 21, which is slidably held by the rear cover 5*c*, is urged by a spring 22 rightward in FIG. 1. The above-mentioned parts 8–17 constitute a contact part in a space partitioned by the base 5*b* and the rear cover 5*c*. The crossbar 14 is actuated by a control lever 63 and an overcurrent tripping part 400 within a space 23.

Figure 7:
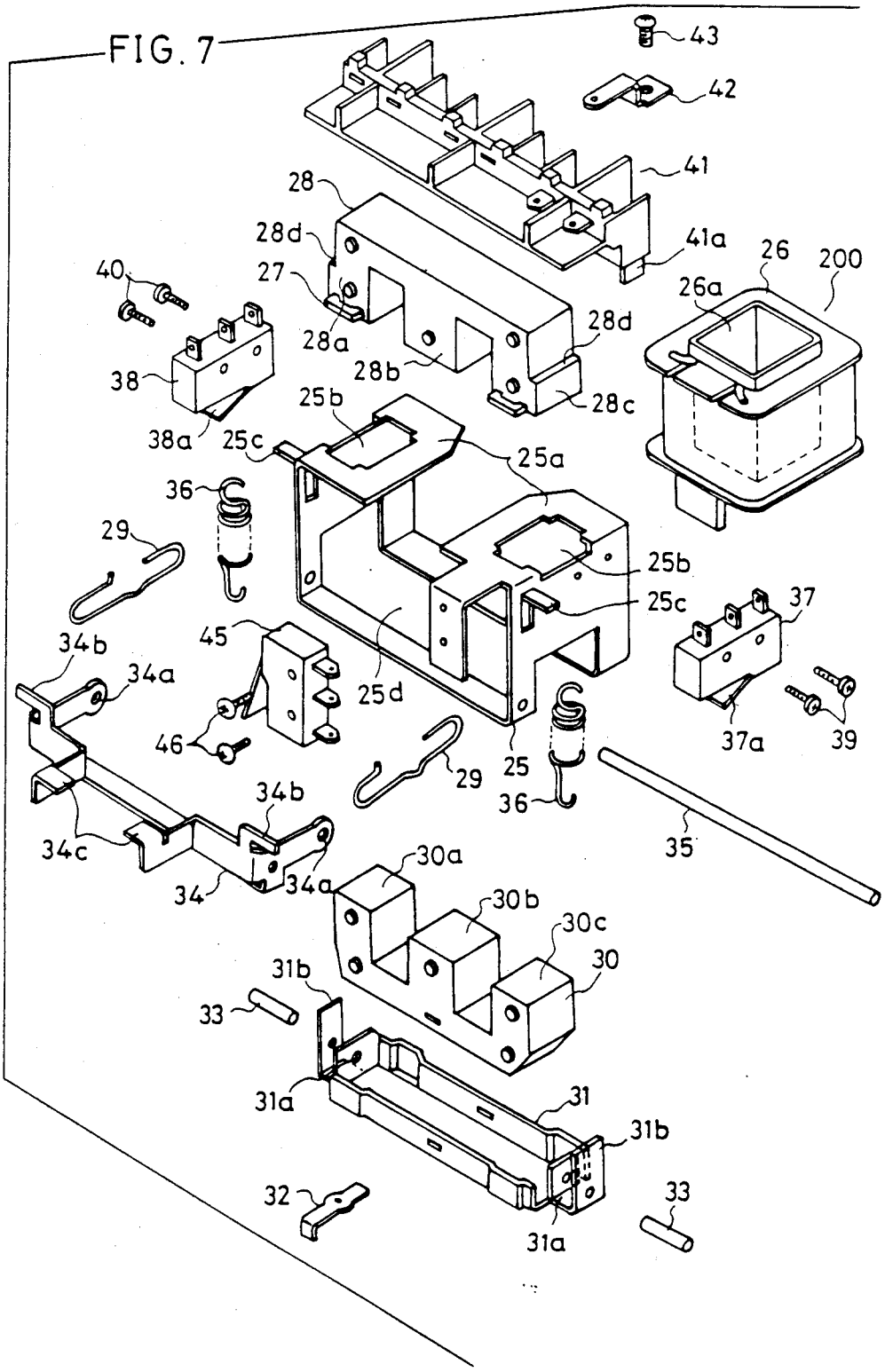
FIG. 7 is a perspective view showing components of an electromagnetic unit 200 in FIG. 1.
Figure 8:
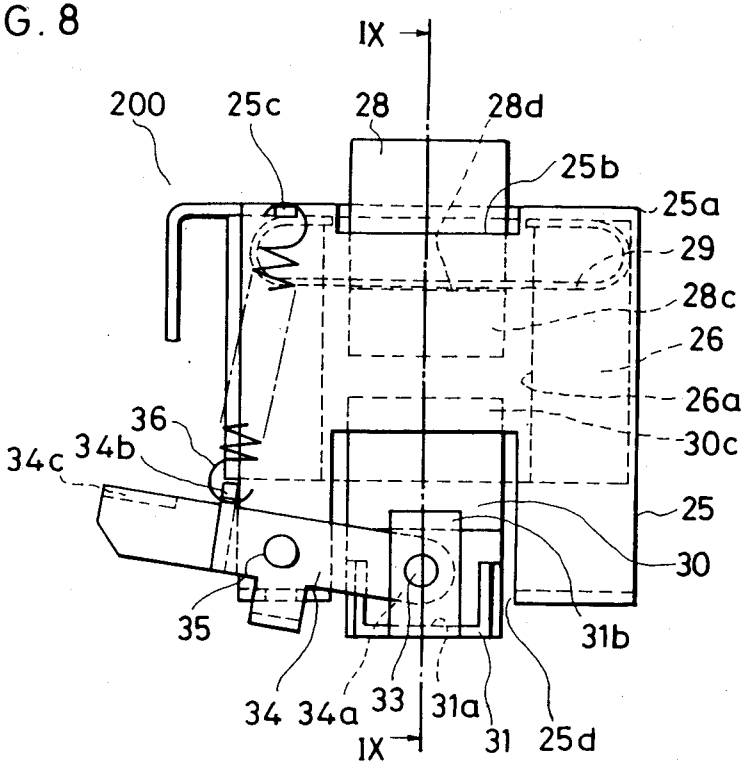
FIG. 8 is a side view showing the electromagnetic unit 200 in FIG. 1.
Figure 9:
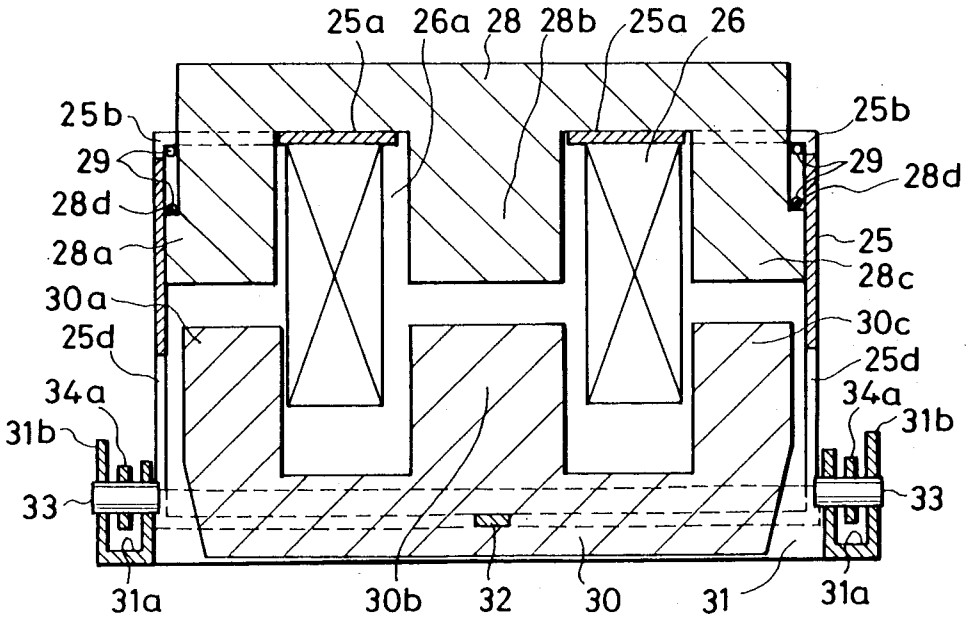
FIG. 9 is a cross-sectional view taken on line IX—IX of FIG. 8.

In a front and power-source side of the circuit breaker, an electromagnetic unit 200 is fixed on the base 5*b* by a screw 24. FIG. 7 is a perspective view showing components of the electromagnetic unit 200. FIG. 8 is a side view showing the electromagnetic unit 200, and FIG. 9 is a cross-sectional view taken on line IX—IX of FIG. 8. In FIG. 7, the electromagnetic unit 200 comprises a channel-shaped magnet frame 25, a cylindrical electromagnetic coil 26, an E-shaped fixed iron core 28, a pair of elastic elements (e.g. a pair of springs) 29, an E-shaped movable iron core 30, a holder 31, a transmission lever 34 and a pair of tension springs 36. The electromagnetic coil 26 is inserted into the inner space of the channel-shaped magnet frame 25. Each of side leg members 28*a* and 28*c* of the fixed iron core 28 has a shading coil 27 fixed thereto at an end part thereof. A central leg member 28*b* of the fixed iron core 28 is downwardly inserted into an opening 26*a* of the electromagnetic coil 26, and both the side leg members 28*a* and 28*c* are downwardly inserted into a pair of openings 25*b* which are formed in a pair of opposing end-plane portions 25*a* of the magnet frame 25, respectively. An elastic element 29 such as a spring is provided between each of projecting parts 28*d* of the fixed iron core 28 and each of the end-plane portions 25*a* of the magnet frame 25 to prevent the fixed iron core 28 from coming out of the magnet frame 25 and to absorb any shock caused by attracting the movable iron core 30. Wear of pole faces of the movable iron core and the fixed iron core is thereby reduced. The movable iron core 30 has leg members 30*a*, 30*b*, and 30*c*. The central leg member 30*b* is upwardly inserted into the opening 26*a* of the electromagnetic coil 26 through an opening 25*d* of the magnet frame 25, and the other side leg members 30*a* and 30*c* are upwardly inserted into the opening 25d. The movable iron core 30 is fixed to the holder 31 by a stopper 32. A pair of bearing members 31a are provided at both ends of the holder 31, and these bearing members 31a are rotatably held by a pair of bearing members 34a of the transmission lever 34 with a pair of pins 33. The transmission lever 34 is pivotally held by the magnet frame 25 with a shaft 35, thereby movably holding the movable iron core 30 in up and down directions against the fixed iron core 28. In response to a stage of whether the electromagnetic coil 26 is excited or not, the movable iron core 30 is attracted to the fixed iron core 28 or released therefrom, thereby generating up and down motions of the movable iron core 30. These up and down motions of the movable iron core 30 is transmitted to the control lever 63 (FIG. 1) via the transmission lever 34. A pair of tension springs 36 are extended between respective projections 34b of the transmission lever 34 and respective projections 25c of the magnet frame 25 to thereby move the movable iron core 30 away from the fixed iron core 28.

A pair of auxiliary switches 37 and 38 are secured to the magnet frame 25 by screws 39 and 40. A pair of projections 31b of the holder 31 are disposed to engage with actuator 37a and 38a, respectively. In response to the movement of the movable iron core 30, the respective actuators 37a and 38a are actuated, thereby making/breaking contact in the auxiliary switches 37 and 38.

Since the transmission lever 34 is disposed outside the magnet frame 25, size of the electromagnetic unit 200 becomes small. Besides, since the electromagnetic unit 200 is constructed into one compact unit as shown by FIGS. 8 and 9, handling of the electromagnetic unit 200 becomes easy and mounting thereof onto the base 5b (FIG. 1), for instance in an automatic assembly machine, is carried out easily. Since the auxiliary switches 37 and 38 are secured to an outer surface of the magnet frame 25, securing of the limit switches 37 and 38 is easily executed too.

A terminal block 41 has plural terminals 42 inserted thereto, and plural screws 43 for connecting external wires (not shown) are provided. Some of the terminals 42 are connected to the auxiliary switches 37 and 38 via lead wires 44 (FIG. 1), and the others of the terminals 42 are connected to the electromagnetic coil 26 directly and via a limit switch 45. That is, the limit switch 45 and the electromagnetic coil 26 of the electromagnetic unit 200 are connected in series with each other. The limit switch 45 is fixed to the magnet frame 25 by screws 46. The screws 43 are accessible through an opening 47 (FIG. 1) in the front cover 5a to enable connection to external wires. The terminal block 41 is fixed on the magnet frame 25 by leg members 41a. The terminal block 41 is usually covered with a terminal cover 48 (FIG. 1) to prevent accidental contact.

In the front-mid part of the circuit breaker in FIG. 1, an operation mechanism unit 300 is located. A frame 49 is fixed to the base 5b by a screw 49a. The operation handle 50, which is projected out of an opening 52, is rotatably held to the frame 49 by a pin 51. An inner protruberance 50a of the operation handle 50 is connected with one end of a link 54 by a pin 53, thereby constituting a toggle link mechanism. A roller 55 is pivotally mounted on the other end of the link 54. A lever 56 is pivotally mounted to the frame 49 by the pin 51. A lower end of the lever 56 is engaged with a latch 57. The latch 57 is pivotally mounted to the frame 49 by a pin 58 and is biased to rotate counterclockwise by a torsion spring (not shown). A trip bar 59 is pivotally mounted to the frame 49 by a pin 60 and is urged to rotate clockwise by a torsion spring (not shown), thereby engaging with the latch 57. A pusher plate 61 is movably mounted in each of U-shaped grooves 49b of the frame 49 in the up and down direction. The pusher plate 61 is biased to move upward by a tension spring 62. The roller 55 rides on an upper end of the pusher plate 61, and the lever 56 is engaged with the roller 55. The control lever 63 is pivotally mounted to the frame 49 by a pin 64. In FIG. 5, one end 63a of the control lever 63 is engaged with the crossbar 14, and the other end 63b thereof is engaged with an engaging member 34c of a transmission lever 34. An edge part 63c of the control lever 63 is disposed within a hole 61a of the pusher plate 61 so that the control lever 63 is allowed to rotate only within a predetermined angular range. In the state of FIG. 1, namely in the OFF-position of the operation handle 50, the right end 63b of the control lever 63 is lifted by the tension spring 62 via the pusher plate 61. Since the urging force applied to the movable conductor 10 by the tension spring 62 is larger than that by the compression spring 15, the control lever 63 is held in a state of FIG. 1. Therefore, both the movable contacts 11 and 12 are detached from the fixed contacts 9 and 16, respectively. At that time, there is a gap between the end 63b of the control lever 63 and the engaging member 34c of the transmission lever 34 as shown in FIG. 1.

Toward the front of the load-side of the circuit breaker, an overcurrent tripping unit 400 having a bimetal and a plunger-shaped electromagnet is provided. The fixed conductor 17 of the load side is secured to an end 65a of a first yoke 65 by a screw 66, and the first yoke 65 has the bimetal 67 welded thereto and an adjusting screw 68. In a bobbin 69, a hollow core 70 secured to the first yoke 65 and a plunger 71 are provided. The plunger 71 is urged to move upward by a compression spring 72. An upper end part 71a of the plunger 71 is engaged with a hole 59a of the trip bar 59. When the plunger 71 is attracted to the core 70, the trip bar 59 is rotated against the torsion spring (not shown). A rod 73 is disposed to pass through a hollow of the core 70 and an opening 74 of the base 5b. When the plunger 71 is attracted to the core 70, the rod 73 lowers through a groove 14a of the crossbar 14 and hits the holder 13, thereby breaking contact between the contacts 9 and 11 and between the contacts 16 and 12. A second yoke 75 is secured to the first yoke 65. One end of a coil 76 is connected to an upper end part of the bimetal 67 via a flexible copper wire 77, and the other end thereof is connected to a terminal 78 of the load side. The terminal 78 has a screw 79 for securing an external wiring (not shown). An actuator 80 is pivotally mounted to the first yoke 65 by a pin 81 and is urged to move counterclockwise by a spring (not shown). An arm member 80a of the actuator 80 is provided to engage with the trip bar 59. By varying the width of a gap A between the upper end part of the bimetal 67 and the opposing actuator 80, delay time for tripping the circuit breaker is adjusted. The gap A is made larger or smaller by turning the adjusting screw 68.

Next, operation of the above-mentioned circuit breaker is described.

In the off state of the circuit breaker as shown in FIGS. 1–3 and 3a, when the operation handle 50 is pushed to the right to thereby set it in the AUTO-position, the link 54 and the operation handle 50 are disposed on an approximately straight line as shown in FIG. 4. The pusher plate 61 is thereby lowered against a force of the spring 62 (FIG. 1), and the edge part 63*c* of the control lever 63 relatively comes into a high position in the hole 61*a* of the pusher plate 61. Accordingly, the control lever 63 is released from a state in which clockwise rotation is restricted by presence of a lower surface of the hole 61*a*. As a result, the control lever 63 receives the force of the spring 15 via the crossbar 14 and is thereby rotated clockwise. When the control lever 63 abuts on the transmission lever 34, rotation of the control lever 63 is stopped by the tension spring 36 which urges the transmission lever 34 to rotate clockwise. This is because, the force of the spring 36 is selected to be greater than that of the spring 15. At that time, the movable conductor 10 is allowed to slightly rise due to the above-mentioned clockwise-rotation of the control lever 63. As a result, a distance between the fixed contact 9 (or 16) and the movable contact 11 (or 12) decreases a little from the state shown in FIGS. 1 and 3*a*.

In the AUTO-position of the operation handle 50 shown by FIG. 4, when the electromagnetic unit 200 is not excited, the limit switch 45 (FIG. 7) is actuated by receiving motion of the pusher plate 61, thereby making contact therein. When a voltage is applied to the terminal 42 (FIG. 1), the coil 26 is excited, and the movable iron core 30 is attracted by the fixed iron core 28. As the movable iron core 30 moves, the transmission lever 34 rotates anticlockwise against the force of the tension spring 36, thereby releasing the control lever 63. Therefore, the movable conductor 10 rises by expansion of the compression spring 15, and the movable contacts 11 and 12 make contact with the fixed contacts 9 and 16, respectively. This state is shown by FIG. 5. In this state, a pair of the projections 31*b* (FIG. 7) of the holder 31 push the actuators 37*a* and 38*a* (FIG. 7), thereby actuating contacts in the auxiliary switches 37 and 38, respectively. At the time when the movable iron core 30 impacts upon the fixed iron core 28, shock is absorbed by the elastic member 29.

In FIG. 5, when the voltage supplied to the terminal 42 (FIG. 1) is removed, the movable iron core 30 separates from the fixed iron core 28 by the force of the tension spring 36. Further, the control lever 63 is rotated anticlockwise by receiving torque of the transmission lever 34 which is biased by the tension spring 36. Since the force to rotate the control lever 63 is larger than the force due to the spring 15 acting on the movable conductor 10, one end 63*a* of the control lever 63 pushes the crossbar 14, thereby breaking contact between the fixed contacts 9 and 16 and the movable contacts 11 and 12, respectively. Thus, the circuit breaker returns to the state shown by FIG. 4. According to the above mentioned operation, opening/closing of contacts is carried out by the remote control (i.e. voltage is supplied or not) through repetition of the states shown by FIGS. 4 and 5 without any operation of the operation mechanism unit 300.

In the state shown by FIG. 5, current flows from the terminal 6 (FIG. 1) of the power-source side to the terminal 78 (FIG. 1) of the load side through the fixed conductor 8, the fixed contact 9, the movable contact 11, the movable conductor 10, the movable contact 12, the fixed contact 16, the fixed conductor 17, the first yoke 65 (FIG. 1), the bimetal 67 (FIG. 1), the flexible copper wire 77 (FIG. 1) and the coil 76 (FIG. 1), in this order.

Next, tripping operation from the state (remote-on) of FIG. 5 to the state (trip) of FIG. 6 is described. When an overcurrent flows through the circuit breaker under the state of FIG. 5, the bimetal 67 (FIG. 1) bends rightward and pushes the actuator 80 (FIG. 1). The trip bar 59 is thereby rotated counterclockwise against the force of the torsion spring (not shown), and the latch 57 is rotated clockwise against the force of the torsion spring (not shown). When the lever 56 is disengaged from the latch 57 by rotation of the latch 57, the roller 55 and the lever 56 are permitted to move leftward. Therefore, the pusher plate 61, which is pulled upward by the tension spring 62 (FIG. 1), pushes the roller 55 and the lever 56 aside and rises, thereby causing counterclockwise-rotation of the control lever 63 against the force of the compression spring 15. Accordingly, the movable contacts 11 and 12 separate from the fixed contacts 9 and 16, respectively. The resultant state is shown in FIG. 6. In this state, a distance between the fixed contact 9 (or 16) and the movable contact 11 (or 12) is larger than that in the state of FIG. 4. As shown in FIG. 6, the operation handle 50 is positioned at an intermediate position after the trip operation, thereby informing the operator that the circuit breaker has tripped.

When the pusher plate 61 rises, the limit switch 45 (FIG. 7) is actuated and breaks its contact. Excitation of the coil 26 is thereby lost, and the ordinary opening operation is carried out as a result. That is, the movable iron core 30 separates from the fixed iron core 28, and the control lever 63 rotates to break contacts between the fixed contacts 9 and 16 and the movable contacts 11 and 12, respectively, via rotation of the transmission lever 34. As a result, two forces of the tension springs 62 and 36 are applied to the movable conductor 10. The movable contacts 11 and 12 separate from the fixed contacts 9 and 16 by extremely strong force against the force of the compression spring 15, respectively.

When short-circuit current flows through the circuit breaker shown in FIG. 5, the coil 76 (FIG. 1) is excited and the plunger 71 (FIG. 1) is instantaneously attracted to the core 70 (FIG. 1). The trip bar 59 is thereby rotated counterclockwise against the force of the torsion spring (not shown). Thereafter, tripping operation is carried out in the same way as that caused by bending of the bimetal 67, thereby breaking contact of the circuit breaker. At the same time, as shown in FIG. 6, the rod 73 connected with the plunger 71 directly hits the holder 13, thereby separating the movable contacts 11 and 12 from the fixed contacts 9 and 16, respectively. Breaking contact generates arcs between the movable contacts 11, 12 and the fixed contact 9, 16, respectively. These arcs move between the movable conductor 10 and the fixed conductors 8 and 17, respectively. Further, the arcs move between a pair of arc runners 92, 93 (FIG. 1) and the fixed conductors 8, 17, respectively. The arcs are thereby divided into pieces and extinguished as a result. Hot gas generated in the arc extinguishing chambers 18A and 18B is exhausted out of the vents 20 through holes (not shown) of the exhaust sheets 18*b* and the exhaust passage 19.

When the operation handle 50 is pushed to the left to thereby put it in the OFF-position from the trip state (FIG. 6), the lever 56 pushes the roller 55 rightward. The roller 55 thereby gets onto the pusher plate 61, and the lever 56 is engaged with the latch 57. Resetting operation is thus completed.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A remote-controlled circuit breaker comprising:

a casing;

a fixed contact fixedly mounted to said casing;

a movable contact movably mounted to said casing to move in and out of contact with said fixed contact;

an electromagnetic unit comprising a channel-shaped magnet frame which has a pair of opposing end-plane portions and is fixedly mounted to said casing, a cylindrical electromagnetic coil mounted in said magnet frame, an E-shaped fixed iron core, a central leg of which is inserted into said electromagnetic coil from one side of said electromagnetic coil and a pair of both sides legs are inserted into said magnet frame from said one side through a pair of openings of said end-plane portions, thereby to be fixed to said magnet frame, an E-shaped movable iron core, a central leg of which is inserted into said electromagnetic coil through an opening of said magnet frame from the other side of said electromagnetic coil and a pair of both sides legs are inserted into said magnet frame from said other side through said opening of said magnet frame, thereby to be movable to said magnet frame, a transmission lever which is pivotally mounted to said magnet frame, a holder which is held by an end part of said transmission lever to hold said movable iron core into and out of contact with said fixed iron core, and a spring which urges said movable iron core away from said fixed iron core;

a control lever which is pivotally mounted to said casing to move said movable contact into and out of contact with said fixed contact;

operation means, including an operation handle, for releasably holding said control lever, said operation means forming a toggle and holding said control lever in a position for moving said movable contact out of contact with said fixed contact when said operation handle is in a first position and releasing said control lever to allow a predetermined rotation thereof when said operation handle is in a second position;

an overcurrent tripping unit for causing said operation means and said control lever to actuate to move said movable contact out of contact with said fixed contact when a current greater than a predetermined value flows through said circuit breaker; and a transmission lever which is pivotally mounted to said casing to transmit a motion of said movable iron core to said control lever.

2. A remote-controlled circuit breaker in accordance with claim 1, further comprising an elastic element which is provided between a projecting part of said movable iron core and each of said end-plane portions of said magnet frame to fix said fixed iron core to said magnet frame.

3. A remote-controlled circuit breaker in accordance with claim 1, wherein said transmission lever is disposed outside said magnet frame, and said holder holds said movable iron core at the outside of said magnet frame.

4. A remote-controlled circuit breaker in accordance with claim 3, further comprising an auxiliary switch which is provided outside said magnet frame to be actuated by detecting a motion of said holder.

* * * * *